US008950417B2

(12) United States Patent
Yang

(10) Patent No.: US 8,950,417 B2
(45) Date of Patent: Feb. 10, 2015

(54) ARTICULATING POLE HUB FOR A COLLAPSIBLE SHELTER AND METHOD OF FORMING A COLLAPSIBLE SHELTER

(71) Applicant: Westfield Outdoor, Inc., Indianapolis, IN (US)

(72) Inventor: Baoqing Yang, HangZhou (CN)

(73) Assignee: Westfield Outdoor, Inc., Indianapolis, IN (US)

( * ) Notice: Subject to any disclaimer, the term of this patent is extended or adjusted under 35 U.S.C. 154(b) by 0 days.

(21) Appl. No.: 13/730,006

(22) Filed: Dec. 28, 2012

(65) Prior Publication Data

US 2014/0182643 A1 Jul. 3, 2014

(51) Int. Cl.
*E04H 15/36* (2006.01)
*E04H 15/48* (2006.01)

(52) U.S. Cl.
CPC ..... *E04H 15/48* (2013.01); *Y10S 135/909* (2013.01)
USPC ..... 135/147; 135/132; 135/153; 135/909

(58) Field of Classification Search
USPC ..... 135/120.2, 120.3, 132, 133, 135, 147, 135/151, 152, 95, 909
See application file for complete search history.

(56) References Cited

U.S. PATENT DOCUMENTS

| | | | | | |
|---|---|---|---|---|---|
| 706,605 | A * | 8/1902 | Slyder | 296/102 |
| 2,113,118 | A | 4/1938 | Pyatt | |
| 2,547,770 | A * | 4/1951 | Pelton | 135/126 |
| 2,808,846 | A | 10/1957 | Jonsson | |
| 2,953,145 | A | 9/1960 | Moss et al. | |
| 3,054,413 | A | 9/1962 | Eshelman | |
| 3,550,601 | A | 12/1970 | Peters | |
| 3,810,482 | A | 5/1974 | Beavers | |
| 4,265,259 | A * | 5/1981 | Gillis | 135/127 |
| 4,285,354 | A | 8/1981 | Beavers | |
| 4,349,040 | A * | 9/1982 | Miller | 4/503 |
| 4,414,993 | A * | 11/1983 | Gillis | 135/127 |
| 4,750,509 | A | 6/1988 | Kim | |
| 4,877,044 | A * | 10/1989 | Cantwell et al. | 135/127 |
| 4,933,019 | A * | 6/1990 | Peruski | 135/123 |
| 4,966,178 | A | 10/1990 | Eichhorn | |
| 5,423,341 | A | 6/1995 | Brady | |
| 5,628,338 | A | 5/1997 | Stumbo | |
| 5,666,986 | A | 9/1997 | Fox | |
| 5,732,726 | A | 3/1998 | Lee | |
| 6,089,245 | A * | 7/2000 | Tseytlin et al. | 135/88.01 |
| 6,116,256 | A | 9/2000 | Pawsey et al. | |
| 6,170,504 | B1 * | 1/2001 | Tsai | 135/121 |
| 6,776,179 | B1 | 8/2004 | Chen | |
| 7,802,582 | B2 * | 9/2010 | Livacich et al. | 135/147 |
| 8,448,656 | B2 | 5/2013 | Choi | |
| 2007/0215192 | A1 * | 9/2007 | Hoffman | 135/135 |

FOREIGN PATENT DOCUMENTS

| | | | |
|---|---|---|---|
| CA | 2022369 | A1 | 2/1991 |
| CN | 1076987 | A | 10/1993 |
| CN | 201129060 | Y | 10/2008 |

* cited by examiner

*Primary Examiner* — Noah Chandler Hawk
(74) *Attorney, Agent, or Firm* — Thompson Coburn LLP

(57) ABSTRACT

A pole hub for a collapsible shelter, such as a tent, canopy, or sun-shade is configured and adapted to connect at least two pairs of poles to each other in manner such that the pairs of poles are able to pivot relative to each other about an axis, while each pair of poles remains generally rigid.

12 Claims, 3 Drawing Sheets

FIG. 3
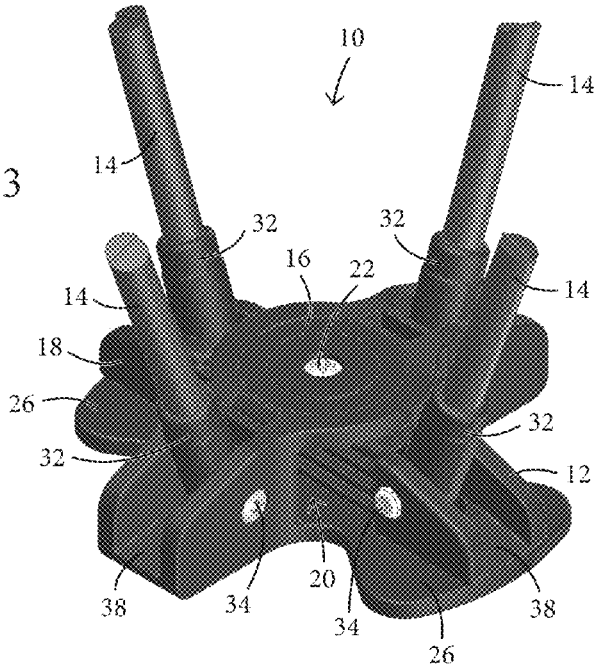
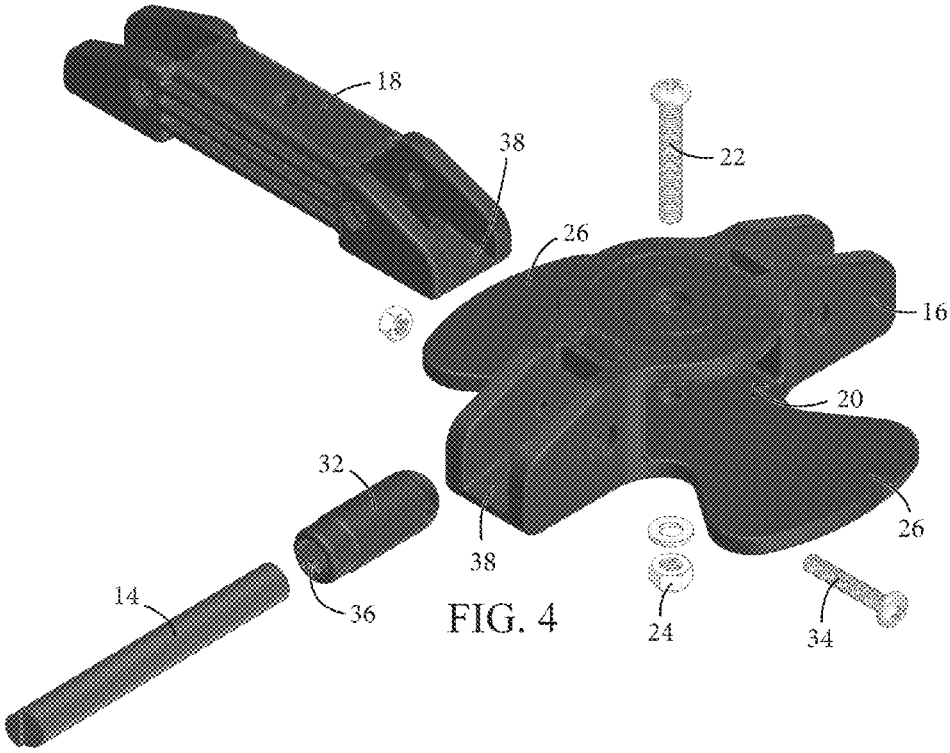
FIG. 4

ARTICULATING POLE HUB FOR A COLLAPSIBLE SHELTER AND METHOD OF FORMING A COLLAPSIBLE SHELTER

CROSS-REFERENCE TO RELATED APPLICATIONS

Not Applicable.

STATEMENT REGARDING FEDERALLY SPONSORED RESEARCH OR DEVELOPMENT

Not Applicable.

APPENDIX

Not Applicable.

BACKGROUND OF THE INVENTION

1. Field of the Invention

This invention pertains to collapsible shelters, such as tents, canopies, and sun-shades. More particularly, the present invention pertains to a hub for connecting support poles of a shelter in a manner such that the poles that are directly attached to the hub are not all rigidly connected to each other.

2. General Background

Collapsible shelters, such as tents, canopies, and sun-shades often comprise a pliable shell supported by a plurality of structural poles that can be selectively detached from each other, or otherwise collapsed, in a manner such that the shelter can be selectively erected and, alternatively, collapsed. In some cases, the structural assembly of poles is configured to be separated from the pliable shell as the shelter is being collapsed. More recently, it is becoming common to configure a collapsible shelter such that its structural poles remain connected to each other and to the pliable shell of the shelter when the shelter is collapsed.

There are two very common types of pole assemblies used in connection with collapsible shelters. One type utilizes a plurality of poles that are held together via an elastic cord (often called shock cord) that passes longitudinally through the hollow centers of a plurality of poles in a manner such that socket fittings are sufficient to maintain the poles in an erected configuration. Another type utilizes poles that are hinged or telescoping. In general, the former is lighter than the latter and the latter is generally more rigid and strong. The present invention can be used in connection with either type of pole assemblies.

Although the assembly of poles provides support for the pliable shell, in many cases the pliable shell of the shelter works in concert with the assembly of poles to structurally support the shelter in its erected configuration. In other words, the pliable shell of a collapsible shelter often serves as tension and shear panels that prevent the pole assemblies from buckling or twisting. Thus, the pole assemblies need not be self-supported.

In an effort to reduce the weight of collapsible shelters to facilitate the transportation of such shelters, the structural poles are typically minimally sized for anticipated load requirements. As a result, the fittings and other components that connect the poles to each other in their erected configuration, and the poles themselves, can experience high bending stresses. This can lead to component failure or fatigue.

SUMMARY OF THE INVENTION

The present invention pertains to a hub that is configured and adapted to connect at least two pairs of poles to each other in a manner such that the pairs of poles are able to pivot relative to each other, while each pair of poles remains generally rigid. By allowing the pairs of poles to pivot relative to each other, bending loads on the hub are reduced, and the pliable shell of the shelter is able to more efficiently transfer load from pair to pair. This also allows collapsible shelters to more easily accommodate and absorb wind and impact loads. Still further, the pivotal nature of the hub allows a collapsible shelter to be collapsed and erected with greater ease.

In one aspect of the invention, a hub and pole assembly for a collapsible shelter, such as a tent, canopy, or sun-shade, comprises first and second hub portions that are connected to each other in a manner such that the first and second hub portions are pivotal relative to each other generally about a hub axis. The hub axis generally defines circumferential, axial, and radial directions. The first hub portion attaches a first set of at least two poles to each other in a manner such that the first set of poles maintain their circumferential spacing about the hub axis. The second hub portion attaches a second set of at least two other poles to each other in a manner such that the second set of poles maintain their circumferential spacing about the hub axis. The pivotal connection between the first and second hub portions allows the first set of poles to pivot about the hub axis relative to the second set of poles.

In another aspect of the invention, a pole hub assembly for a collapsible shelter, such as a tent, canopy, or sun-shade, comprises first and second crossmembers and a plurality of pole attachment portions. The first and second crossmembers are attached to each other in a manner such that the first and second crossmembers can pivot relative to each other generally about a hub axis and in a manner such that the first and second crossmembers crisscross each other. The hub axis generally defines radial and axial directions. Each of the first and second crossmembers has opposite end portions, each of the end portions has a respective one of the pole attachment portions pivotally attached thereto in a manner such that the respective pole attachment portion is pivotal about a respective pole attachment axis that is generally perpendicular to both the radial and axial directions. Each of the pole attachment portions comprises a socket that is adapted and configured to receive an end of a tent-type pole.

In yet another aspect of the invention, a collapsible shelter comprises a pliable shell supported by a pole assembly. The pole assembly comprises a first pair of poles and a second pair of poles. The poles of the first pair of poles are connected to each other via a first portion of a hub in a manner defining a first assembly. The poles of the second pair of poles are connected to each other via a second portion of the hub in a manner defining a second assembly. The first and second portions of the hub are pivotally connected to each other generally about a hub axis. The poles extend from the hub in a manner such that the first assembly crisscrosses the second assembly. The pivotal connection between the first and second hub portions allows the first and second assemblies to pivot as separate units relative to each other about the hub axis.

Further features and advantages of the present invention, as well as the operation of the invention, are described in detail below with reference to the accompanying drawings.

BRIEF DESCRIPTION OF THE DRAWINGS

FIG. 3 depicts the hub and pole assembly shown in FIGS. 1 and 2 in its partially collapsed configuration.

FIG. 4 is an assembly view of the hub and pole assembly shown in FIGS. 1-3.

Figure 1:
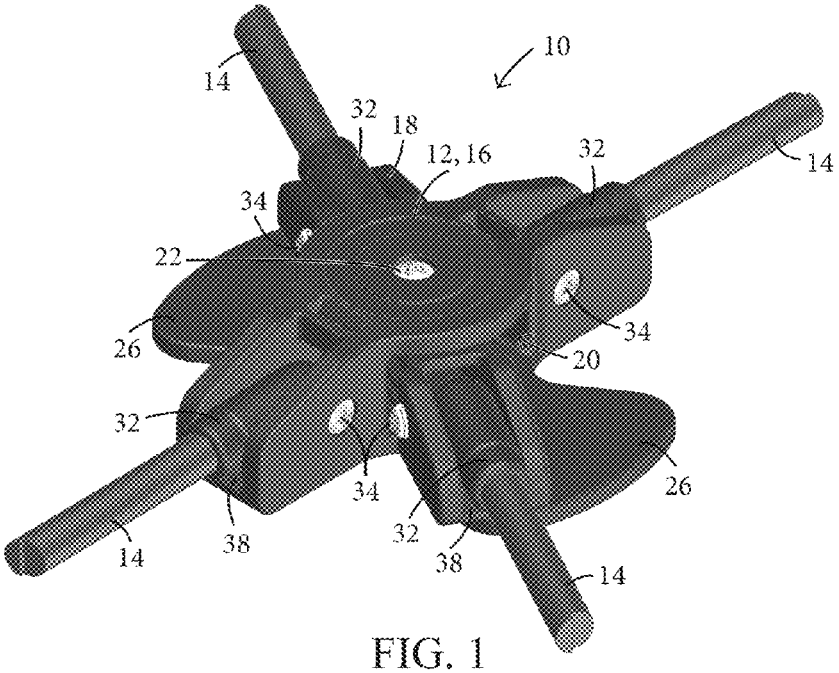
FIG. 1 depicts a perspective view of a hub and pole assembly in accordance with the invention, and is shown with the first and second portions of the hub at one of their two limits of pivotal travel.

Reference numerals in the written specification and in the drawing figures indicate corresponding items.

DETAILED DESCRIPTION

A preferred embodiment of a hub and pole assembly (10) in accordance with the invention is shown by itself in FIGS. 1-4. The hub and pole assembly (10) comprises a hub (12) and a plurality of poles (14) attached thereto.

Figure 2:
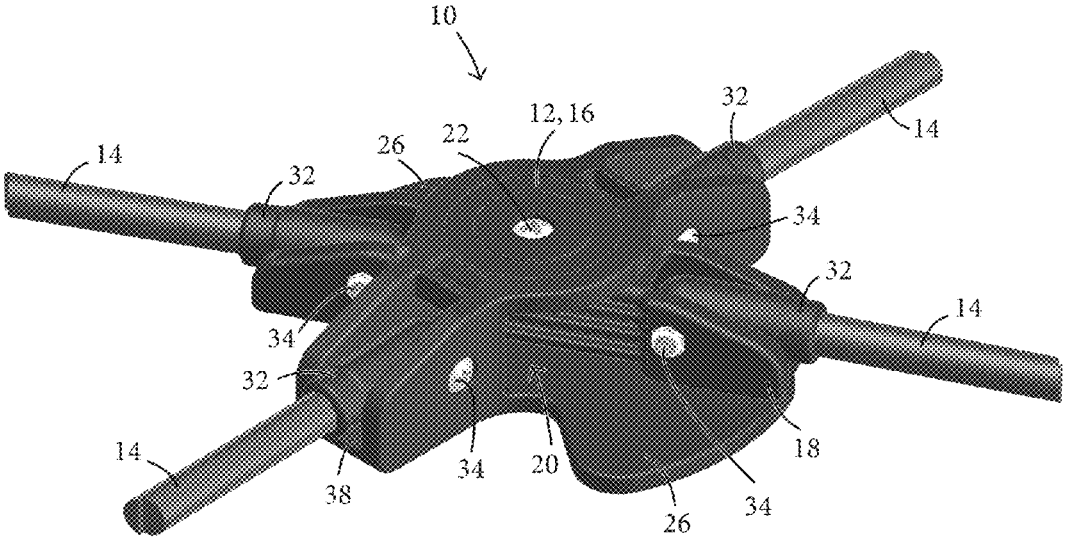
FIG. 2 depicts another perspective view of the hub and pole assembly shown in FIG. 1, showing the first and second portions of the hub at the other limit of pivotal travel.

The hub (10) comprises first and second portions (16, 18) that are pivotally connected to each other about a hub axis. Preferably, the first and second portions (16, 18) are each a crossmember that crisscrosses the other crossmember. To minimize the thickness of the hub (12) without significantly impacting the strength and stiffness of the crossmembers (16, 18), the first crossmember (16) comprises an opening (20) through which the second crossmember (18) extends. A central screw (22) is aligned with the hub axis and extends through the first and second crossmembers (16, 18). A nut (24) secures the central screw (22) to the first crossmember (16) and the central screw (22) serves as an axle about which the second crossmember (18) can pivot. The opening (20) of the first crossmember (16) is preferably dimensioned such that the second crossmember (18) is pivotable through a range of slightly less than sixty degrees relative to the first crossmember (16). In the middle of its pivotable range, the second crossmember (18) preferably extends longitudinally at ninety degrees from the longitudinal direction of the first crossmember (16). FIGS. 1 and 2 depict the two extremes of the pivotal nature between the first and second crossmembers (16, 18). The first crossmember (16) also preferably comprises a pair of oppositely projecting wings (26) that extend outwardly adjacent the opening (20) of the first crossmember. The wings (26) help prevent pliable shell material from interfering with the pivotal nature of the hub (12) when, as shown in FIG. 5, the hub and pole assembly (10) is attached to a pliable shell (28) to form a collapsible shelter (30) .

The hub 12 also preferably comprises a plurality of pole attachment portions (32) that connect the poles (14) to the crossmembers (16, 18). The pole attachment portions (32) preferably are pivotally attached adjacent the longitudinal ends of crossmembers (16, 18) via screws (34). Preferably, the screws (34) are oriented perpendicular to the radial and axial directions defined by the central screw (22) of the hub (12). Each pole attachment portion (32) also preferably comprises a socket (36) configured to receive the end of the pole (14), which is preferably press fit or adhered into the socket such that it cannot easily be removed therefrom. Each of the longitudinal ends of each of the crossmembers (16, 18) preferably comprises a pivot-stop (38) that is configured to engage and abut the respective pole attachment portion (32) in a manner preventing the pole attachment portion from pivoting beyond a particular limit. When a collapsible shelter (30) comprising the hub and pole assembly (10) is in its erected configuration, each pole attachment portion (32) is biased against and firmly engages its respective pivot-stop (38).

Figure 5:
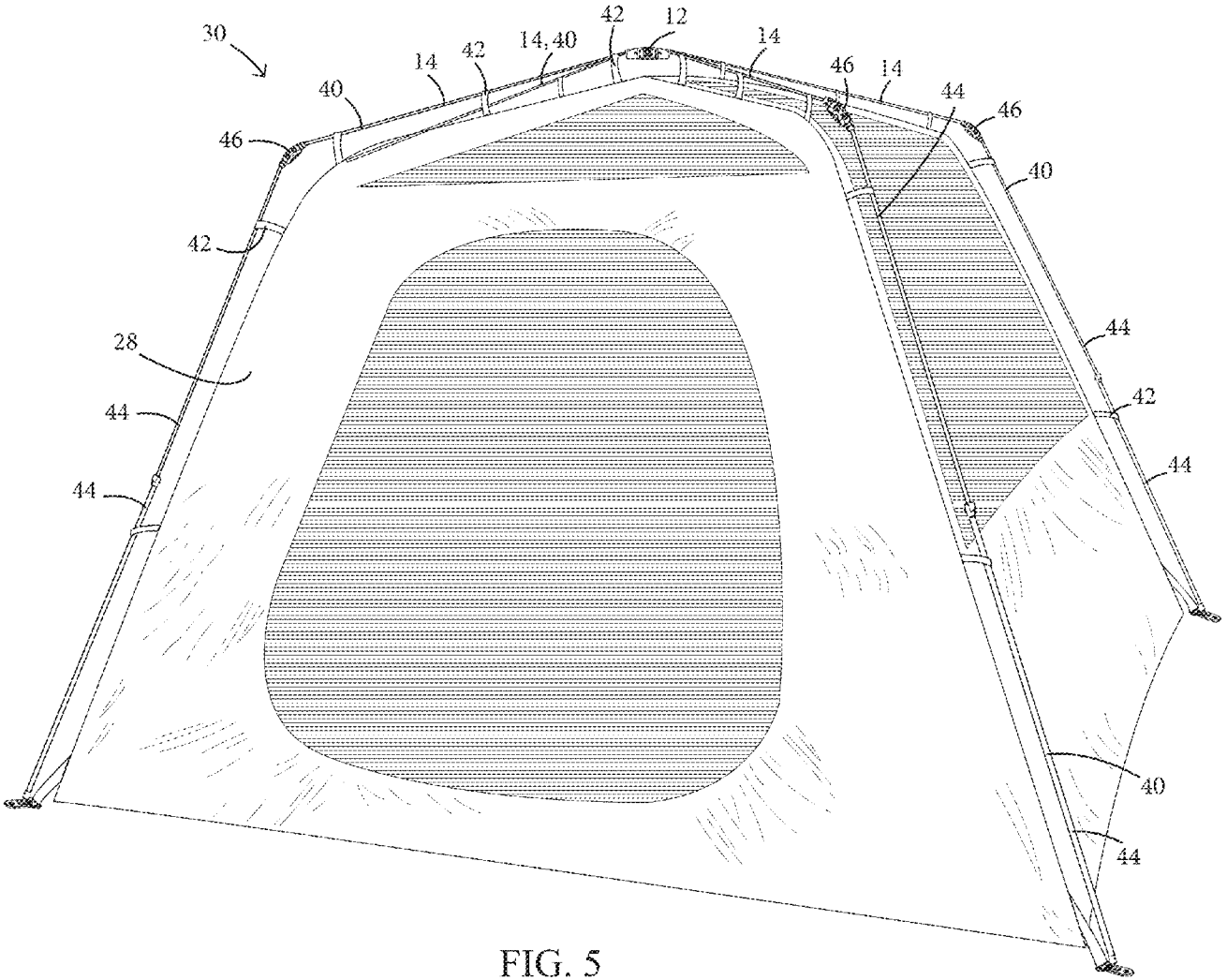
FIG. 5 depicts a collapsible tent that comprises the hub and pole assembly shown in FIGS. 1-4.

The hub and pole assembly (10) of the preferred embodiment is particularly configured to serve as a roof hub and pole assembly of a collapsible shelter (30), as shown in FIG. 5. Each pole (14) that is attached to the hub (12) is preferably one of several poles that together constitute one of several legs (40) of the collapsible shelter (30). As shown in FIG. 5, each leg (40) of the collapsible shelter (30) passes through several loops (42) that are connected to the pliable shell (28) of the shelter. Each leg (40) preferably comprises two telescopically attached pole sections (44) that extend primarily vertical. Each leg (40) also preferably comprises an elbow joint (46) that pivotally connects the upper one of the telescopically attached pole sections (44) to the pole (14) of the leg that is connected to the hub (12). Like the crossmembers (16, 18) of the hub (12), each elbow joint also comprises pivot-stops that prevent the included angle between the telescopically attached pole sections (44) and the pole (14) of the respective leg (40) from decreasing beyond a particular amount, such as that shown in FIG. 5. In view of the foregoing, it should be appreciated that when the collapsible shelter (30) is in its erected configuration (as shown in FIG. 5), each leg (40) is generally rigid. In other words, the leg (40) can resiliently flex but it will not pivot at its elbow joint (46) or relative to the respective crossmember (16 or 18) that it is attached to because the pliable shell prevents it from doing so. Thus, it follows then that the two or more legs (40) that are attached to a particular one of the crossmembers (16, 18) of the hub (12) together also act as a generally rigid unit. Notably however, due to the pivotal nature of the hub (12), such legs (40) are able to pivot about the hub axis relative to the two or more legs (40) that are attached to the other of the crossmembers (16, 18).

When the collapsible shelter (30) is collapsed, the poles (14) attached to the crossmembers (16, 18) pivot about the screws (34) that secure the pole attachment portions (32) to their respective crossmember, as shown in FIG. 3. The telescopically attached pole sections (44) can also be collapsed and the leg can be folded in over itself via the elbow joint (46) that pivotally connects the upper one of the telescopically attached pole sections (44) to the pole (14) of the leg. Thus, the hub and pole assembly (10) allows the collapsible shelter (30) to be stored or transported compactly.

In view of the foregoing, it should be appreciated that the invention has several advantages over the prior art.

As various modifications could be made in the constructions and methods herein described and illustrated without departing from the scope of the invention, it is intended that all matter contained in the foregoing description or shown in the accompanying drawings shall be interpreted as illustrative rather than limiting. Thus, the breadth and scope of the present invention should not be limited by any of the above-described exemplary embodiments, but should be defined only in accordance with the following claims appended hereto and their equivalents.

It should also be understood that when introducing elements of the present invention in the claims or in the above description of exemplary embodiments of the invention, the terms "comprising," "including," and "having" are intended to be open-ended and mean that there may be additional elements other than the listed elements. Additionally, the term "portion" should be construed as meaning some or all of the item or element that it qualifies. Moreover, use of identifiers such as first, second, and third should not be construed in a manner imposing any relative position or time sequence between limitations. Still further, the order in which the steps of any method claim that follows are presented should not be construed in a manner limiting the order in which such steps must be performed, unless such and order is inherent.

What is claimed is:

1. A hub and pole assembly for a collapsible shelter, such as a tent, canopy, or sun-shade, the hub and pole assembly comprising first and second hub portions that are connected to each other in a manner such that the first and second hub portions are pivotal relative to each other generally about a hub axis, the hub axis generally defining circumferential, axial, and radial directions, the first hub portion attaching a first set of at least two poles to each other in a manner such that the first set of poles maintain their circumferential spacing about the hub axis, the second hub portion attaching a second set of at least two other poles to each other in a manner such that the second set of poles maintain their circumferential spacing about the hub axis, the first and second hub portions being configured and adapted to support the first and second sets of poles in orientations such that the first and second sets of poles would, if extended longitudinally toward each other, intersect each other, the pivotal connection between the first and second hub portions allowing the first set of poles to pivot about the hub axis relative to the second set of poles.

2. A hub and pole assembly in accordance with claim 1 wherein each of the poles of the first set of poles is fixed to the first hub portion in a manner such that said poles cannot be removed from the first hub portion without a tool.

3. A hub and pole assembly in accordance with claim 1 wherein each of the poles of the first set of poles is pivotally attached to the first hub portion about a respective pole attachment axis that is generally perpendicular to the radial and axial directions, each of the poles of the second set of poles is pivotally attached to the second hub portion about a respective pole attachment axis that is generally perpendicular to the radial and axial directions, the poles of the first set of poles are otherwise fixed relative to the first hub portion, and the poles of the second set of poles are otherwise fixed relative to the second hub portion.

4. A hub and pole assembly in accordance with claim 1 wherein the first hub portion comprises a central opening that extends radially through the first hub portion and that intersects the hub axis, and the second hub portion extends through the opening.

5. A tent comprising the hub and pole assembly of claim 4, the hub and pole assembly constituting a centrally positioned roof hub and pole assembly of the tent.

6. A hub and pole assembly in accordance with claim 1 wherein the first set of poles comprises no more than two poles and the second set of poles comprises no more two poles, the two poles of the first set of poles are oriented circumferentially 180 degrees apart, and the two poles of the second set of poles are oriented circumferentially 180 degrees apart.

7. A hub and pole assembly in accordance with claim 6 wherein the first and second hub portions are configured such that the first and second hub portions can pivot no more than sixty degrees relative to each other about the hub axis.

8. A pole hub assembly for a collapsible shelter, such as a tent, canopy, or sun-shade, the pole hub comprising first and second crossmembers and a plurality of pole attachment portions, the first and second crossmembers being attached to each other in a manner such that the first and second crossmembers can pivot relative to each other generally about a hub axis and in a manner such that the first and second crossmembers crisscross each other, the hub axis generally defining radial and axial directions, each of the first and second crossmembers having opposite end portions, each of the end portions having a respective one of the pole attachment portions pivotally attached thereto in a manner such that the respective pole attachment portion is pivotal about a respective pole attachment axis that is generally perpendicular to both the radial and axial directions, each of the pole attachment portions being otherwise fixed relative to the respective end portion, each of the pole attachment portions comprising a socket that is adapted and configured to receive an end of a tent-type pole, the first crossmember comprising a central opening that extends radially through the first cross member and that intersects the hub axis, the second crossmember through the opening.

9. A collapsible shelter comprising a pliable shell supported by a pole assembly, the pole assembly comprising a first pair of poles and a second pair of poles, the poles of the first pair of poles are connected to each other via a first portion of a hub in a manner defining a first assembly, the poles of the second pair of poles are connected to each other via a second portion of the hub in a manner defining a second assembly, the first and second portions of the hub being pivotally connected to each other generally about a hub axis, the poles extending from the hub in a manner such that the first assembly crisscrosses the second assembly and such that the first and second pairs of poles would, if extended longitudinally toward each other, intersect each other, the pivotal connection between the first and second hub portions allowing the first and second assemblies to pivot as separate units relative to each other about the hub axis.

10. A collapsible shelter in accordance with claim 9 wherein the first and second portions of the hub are configured such that the first and second portions of the hub can pivot no more than sixty degrees relative to each other about the hub axis.

11. A collapsible shelter in accordance with claim 9 wherein the first portion of the hub comprises a central hole that extends through the first portion of the hub and is perpendicular to the hub axis and the second portion of the hub extends through the hole.

12. A collapsible shelter in accordance with claim 9 wherein the hub axis defines radial and axial directions, each of the poles of the first pair of poles is pivotally attached to the first portion of the hub about a respective pole attachment axis that is generally perpendicular to the radial and axial directions, each of the poles of the second pair of poles is pivotally attached to the second portion of the hub about a respective pole attachment axis that is generally perpendicular to the radial and axial directions, the poles of the first pair of poles are otherwise fixed relative to the first hub portion, and the poles of the second pair of poles are otherwise fixed relative to the second hub portion.

* * * * *

UNITED STATES PATENT AND TRADEMARK OFFICE

CERTIFICATE OF CORRECTION

PATENT NO. : 8,950,417 B2
APPLICATION NO. : 13/730006
DATED : February 10, 2015
INVENTOR(S) : Baoqing Yang It is certified that error appears in the above-identified patent and that said Letters Patent is hereby corrected as shown below:

In the Claims

In column 5, line 46, Claim 6, please add -- than -- after -- more --

In column 6, line 19, Claim 8, please add -- extending -- after -- member --

Signed and Sealed this
Ninth Day of June, 2015

Michelle K. Lee

Michelle K. Lee
*Director of the United States Patent and Trademark Office*